United States Patent [19]

Udell

[11] Patent Number: 4,930,597

[45] Date of Patent: Jun. 5, 1990

[54] NOISE ATTENUATION APPARATUS

[75] Inventor: Randal R. Udell, Columbus, Ind.

[73] Assignee: Arvin Industries, Inc., Columbus, Ind.

[21] Appl. No.: 334,901

[22] Filed: Apr. 7, 1989

[51] Int. Cl.[5] ..... F01N 1/10

[52] U.S. Cl. ..... 181/256; 181/265; 181/272

[58] Field of Search ..... 181/248, 250, 252, 256, 181/265, 266, 282

[56] References Cited

U.S. PATENT DOCUMENTS

| | | | |
|---|---|---|---|
| 2,115,113 | 4/1938 | Mackenzie et al. | 181/250 |
| 2,934,161 | 4/1960 | Powers | 181/266 |
| 3,388,768 | 6/1968 | Heath et al. | 181/266 |
| 3,981,378 | 9/1976 | Potter | 181/252 X |
| 4,278,147 | 7/1981 | Watanabe et al. | 181/256 |
| 4,396,090 | 8/1983 | Wolfhugel | 181/282 |
| 4,577,724 | 3/1986 | Vizard | 181/265 |
| 4,589,517 | 5/1986 | Fukuda | 181/265 |

*Primary Examiner*—Benjamin R. Fuller

*Attorney, Agent, or Firm*—Barnes & Thornburg

[57] ABSTRACT

A tubular sock made of fibrous material is placed over a louver patch formed in an exhaust flow tube mounted in a muffler to attenuate engine exhaust noise. A slip tube is provided for preventing the tubular sock from becoming entangled on the louver patch as it is being placed on the exhaust flow tube.

9 Claims, 2 Drawing Sheets

NOISE ATTENUATION APPARATUS

BACKGROUND AND SUMMARY OF THE INVENTION

The present invention relates to a noise attenuation apparatus, and in particular to an apparatus for use in a vehicle muffler to attenuate noise generated by vehicle exhaust. More particularly, the present invention relates to a tubular noise attenuation sock or sleeve fitted on a louvered exhaust tube in a vehicle muffler to intercept exhaust discharged through louvers formed in the exhaust tube.

Mufflers typically include a plurality of exhaust tubes for conducting hot exhaust gases emitted from the exhaust manifold along a variety of paths through the muffler. A plurality of separate sound absorption chambers are defined in the muffler by baffles or partitions and these chambers are connected together by the exhaust tubes to guide the flow of exhaust gases passing through the muffler to the vehicle exhaust pipe.

High-frequency noise generated by engine exhaust can cause unacceptable "in-car" and "pass-by" sound quality. Typically, vehicle mufflers are configured to include some type of device for attenuating high-frequency exhaust noise. One aim of the present invention is to attenuate high-frequency exhaust noise in a muffler using an improved filter that is easily installed in any of the sound absorption chambers of a muffler at low cost.

It is known to pack one or more of the sound absorption chambers in a muffler completely with an absorptive fibrous material to attenuate sound in the muffler. For example, U.S. Pat. No. 4,396,090 to Wolfhugel shows a muffler in which each absorption chamber is completely filled with mineral wool. Although sound attenuation of certain higher frequency ranges is achieved using such chamber-filling materials, the manufacturing cost of such a design is high because of the large quantity of fibrous material needed to fill one or more of the muffler sound absorption chambers.

It is also known to cover louvers formed in an exhaust flow tube using a hollow sheet-metal shell or other "cover tube assembly" to provide a high-frequency attenuation chamber mounted on an exterior surface of the exhaust flow tube. For example, U.S. Pat. No. 3,388,768 to Heath et al. shows a plurality of such hollow shells attached to exhaust flow tubes to cover louver banks formed in those tubes and establish a gas-tight attenuation chamber. Other examples are provided in U.S. Pat. Nos. 2,115,113 to MacKenzie et al. and 2,934,161 to Powers.

The manufacturing complexity and cost of producing a muffler assembly capable of attenuating high-frequency noise generated by engine exhaust using conventional cover tube assemblies is relatively high. For example, the individual hollow sheet metal shells must be made and attached to the exhaust flow tubes to provide high-frequency attenuation chambers on the exhaust flow tubes. Furthermore, each conventional cover tube assembly typically provides a single high-frequency attenuation chamber that is small in comparison to the muffler sound absorption chamber in which it resides. Essentially, exhaust discharged into such a conventional gas-tight cover tube assembly is retained therein and not permitted to expand into the surrounding muffler sound absorption chamber where low-and mid-range frequency noise generated by such- exhaust could also be attenuated.

One object of the present invention is to provide a filter for attenuating high-frequency engine exhaust noise that is easily installed in a muffler at low cost.

Another object of the present invention is to provide a filter configured to attenuate high-frequency exhaust noise without unnecessarily hindering maximum attenuation of low and middle frequency noise generated by engine exhaust.

According to the present invention, a noise attenuation apparatus includes an elongated prefabricated fibrous member. The fibrous member is formed to include means for receiving an exhaust tube therein so that the fibrous member jackets the exhaust tube to intercept exhaust discharged through louvers or other side discharge apertures formed in the exhaust tube along its length. The fibrous member provides an exhaust-permeable jacket which effectively covers the exhaust tube louvers to attenuate noise generated by the exhaust.

In preferred embodiments, the fibrous member is a cylindrically shaped tube having an aperture extending along its entire length. The aperture is sized to receive a louvered exhaust tube therein so that the fibrous member fits snugly around the louvered exhaust tube.

Illustratively, the fibrous member is made of stainless steel wool spun about a mandrel to provide an open-ended tube sock or sleeve. The sock is configured so that it can be easily slipped onto a louvered exhaust tube as an athletic tube sock is slipped onto an athlete's leg. Once in place, the sock provides a high-frequency noise attenuation filter covering the exhaust-venting louvers in the exhaust tube.

Provision of a stainless steel wool sock on one or more of the exhaust tubes in a muffler makes the practice of completely packing the interior of a muffler with steel wool no longer necessary. A significant cost savings is thereby achieved because the amount of steel wool used to construct enough socks for a muffler is substantially less than the amount of steel wool that would be needed to fill the interior of a muffler. Such a sock also eliminates any need to mount a cover tube assembly on such exhaust tubes to cover the louver openings in formed in those exhaust tubes, thereby reducing manufacturing complexity and cost. In addition, such a sock is constructed of exhaust-permeable material so that engine exhaust discharged through such louver openings is expanded into the larger volume sound absorption chamber in which the sock resides. This expansion effectively causes low and mid-range frequency noise in the exhaust discharged through the louver openings to be attenuated in the sound absorption chamber at the same time that high-frequency noise in such exhaust is attenuated in the exhaust-permeable sock.

Additional objects, features, and advantages of the invention will become apparent to those skilled in the art upon consideration of the following detailed description of preferred embodiments exemplifying the best mode of carrying out the invention as presently perceived.

Brief Description of the Drawings

The detailed description particularly refers to the accompanying figures in which.

DETAILED DESCRIPTION OF THE DRAWINGS

Figure 1:
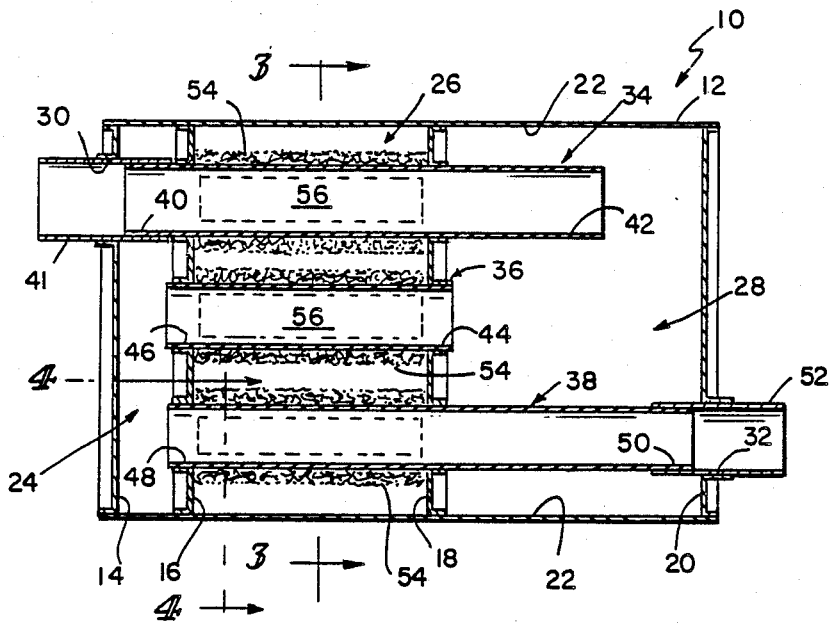
FIG. 1 is a longitudinal cross section through a muffler showing several noise attenuation shocks in accordance with the present invention in place on louvered exhaust tubes in a sound absorption chamber formed in the muffler.

A muffler 10 for use in a vehicle exhaust system (not shown) includes a shell 12 and four transverse partitions 14, 16, 18, and 20 attached to an inner surface 22 of the shell 12 as shown in FIG. 1. These partitions 14, 16, 18, and 20 cooperate with the shell 12 to define a forward chamber 24, a reversing-section chamber 26, and a rearward chamber 28 in the interior region of the muffler 10. Partitions 14 and 20 are located to provide outside end walls of the muffler 10. Inlet header partition 14 is formed to include a tube-receiving aperture 30 and outlet header partition 20 is formed to include a tube-receiving aperture 32. Although muffler 10 is shown as a rolled tube having an oval transverse cross section, it will be understood that any muffler of stamped or rolled construction having muffler chambers therein can be adapted for use in the present invention.

Illustratively, three exhaust flow tubes 34, 36, and 38 are mounted in the inner partitions 16, 18 as shown in FIG. 1 to guide exhaust through muffler 10 from inlet aperture 30 to outlet aperture 32. Inlet tube 34 has an inlet end 40 positioned in forward chamber 24 and connected to an inlet conduit 41 mounted in the inlet aperture 30. An outlet end 42 of tube 34 empties into rearward chamber 28. Intermediate tube 36 has an inlet end 44 positioned in rearward chamber 28 and an outlet end 46 positioned in forward chamber 24. Outlet tube 38 has an inlet end 48 positioned in forward chamber 28 and an outlet end 50 positioned in rearward chamber 28. An outlet conduit 52 is mounted in outlet aperture 32 and connected to outlet end 50 to discharge exhaust conducted by outlet tube 38 to the exhaust pipe (not shown) without emptying such exhaust into the rearward chamber 28.

Figure 3:
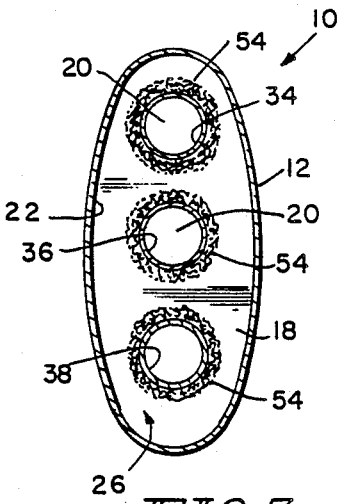
FIG. 3 is a transverse cross section taken along lines 3—3 of FIG. 1 to show the comparatively larger volume of the sound absorption chamber into which exhaust can migrate after passing through one of the exhaust permeable noise attenuation socks.

As shown in FIGS. 1 and 3, an exhaust-permeable tubular sock 54 is placed on each of flow tubes 34, 36, and 38 to cover exhaust-venting opening sections 56 so that any exhaust discharged into reversing-section chamber 26 through one of those sections 56 must first pass through one of the tubular socks 54. Each section 56 could be a group of louvers 66 as shown best in FIG. 4 or other openings. Each of socks 54 is made of a fibrous material such as stainless steel wool to provide a filter for attenuating high-frequency noise associated with engine exhaust discharged through sections 56 into reversing-section chamber 26.

Advantageously, the porous socks 54 permit entry of exhaust discharged from sections 56 into the reversing-section chamber 26 containing the socks 54 so that a wide range of noise frequencies can be attenuated therein. This feature makes effective use of the entire volume of reversing-section chamber to attenuate exhaust noise. Thus, broad band noise attenuation of both high and low frequencies is achieved in reversing-section 26 because of the porous filter means provided by tubular socks 54.

In a preferred embodiment, the tubular sock 54 is made of AISI grade 434 stainless steel wool of the kind available from American Metal Fibers of Lake Bluff, Ill. The density of the wool can be varied in radial directions or axial directions or both in the sock 54 to tune the sock to attenuate selected noise frequencies. Such variation could be linear or non-linear. Advantageously, much less wool is used to fabricate three socks 54 for placement on flow tubes 34, 36, and 38 than would be needed to pack reversing-section chamber 26 with such wool. Various sizes and shapes of tubular socks may be used on exhaust flow tubes in a muffler, depending on the acoustical characteristics of the exhaust system (i.e., pipe length, attenuating volumes, and exhaust source, etc.)

Figure 2:
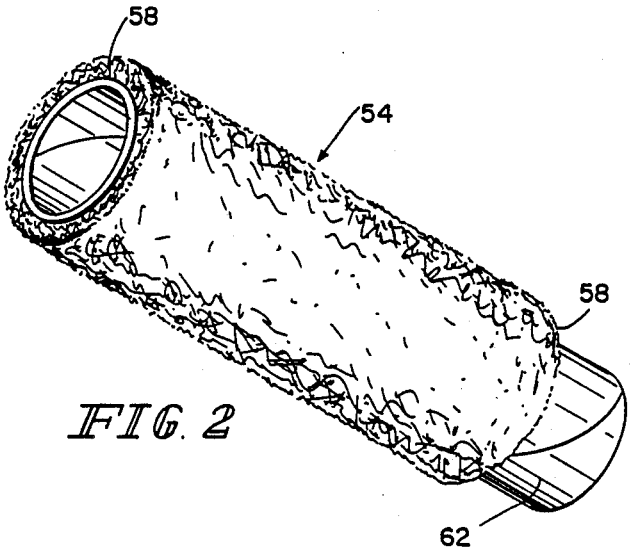
FIG. 2 is a perspective view of a noise attenuation sock of the type illustrated in FIG. 1; before its installation into a muffler and a disposable slip tube around which the sock is formed.

Each sock 54 can be constructed to a custom size by spinning steel wool around a mandrel (not shown) to form a seamless, open-ended tube-shaped sock 54 having a flat annular end portion 58 at each end and a cylindrical inner wall 60 extending between end portions 58. The cylindrical inner wall 60 defines a longitudinally extending aperture for receiving an exhaust flow tube therein. Preferably, each sock 54 is formed on a protective slip tube or sleeve 62 as shown in FIG. 2. The slip tube 62 can be made, for example, of a cardboard or plastics material.

Figure 4:
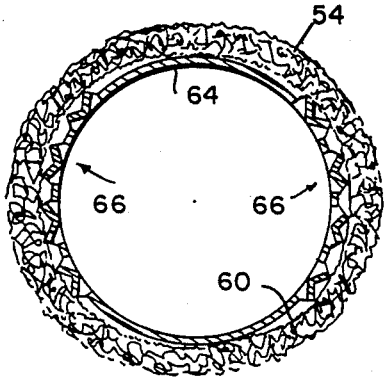
FIG. 4 is an enlarged transverse section of one of the noise attenuation socks of FIG. 1 taken along lines 4—4 in FIG. 1 showing the fibrous sock surrounding louvers formed in the exhaust tube.

The slip tube 62 functions to prevent the steel wool fibers of sock 54 from snagging or otherwise becoming entangled with louvers or the like formed on an exhaust flow tube inserted into the tube-receiving aperture 60 formed in the sock 54. An exhaust flow tube 64 formed to include radially outwardly extending louvers 66 is illustrated in FIG. 4. It will be appreciated that sock 54 fits snugly against flow tube 64 and louvers 66 after removal of the protective slip tube 62 from its place in the longitudinally extending aperture 60 of tubular sock 54 as shown in FIGS. 1 and 3.

Figure 5:
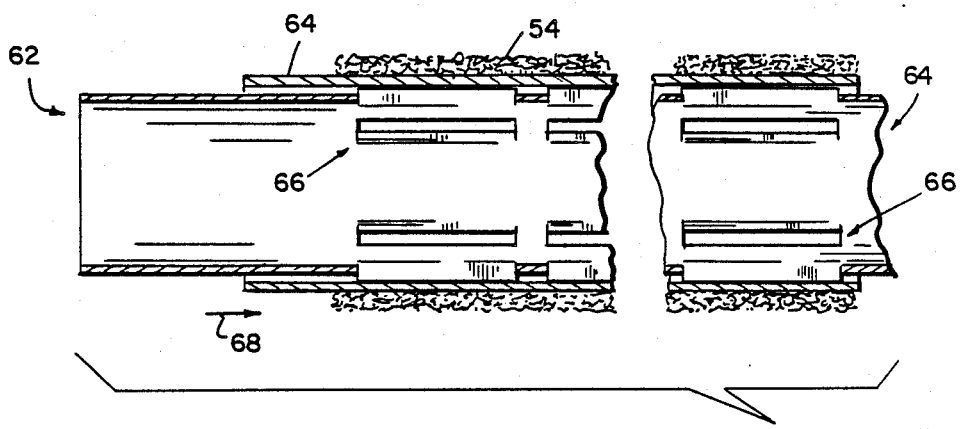
FIG. 5 is a longitudinal cross section through an exhaust tube of the type illustrated in FIGS. 1 and 3 showing a noise attenuation sock after it has been slid onto a louvered exhaust tube and before the slip tube positioned between the sock and the exhaust tube is withdrawn.
Figure 6:
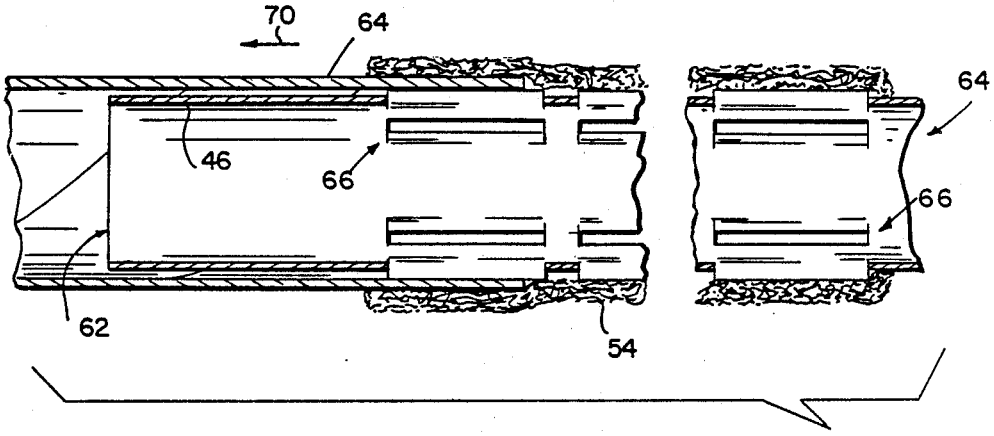
FIG. 6 is a view similar to FIG. 5 of the position of the sock on the exhaust tube as the disposable slip tube is withdrawn.

A tubular sock 54 is slipped onto an exhaust flow tube 64 in the manner illustrated in FIGS. 5 and 6. As shown in FIG. 5, the slip tube 62 is slid in direction 68 onto the flow tube 64 a distance sufficient to position the tubular sock 54 over one or more patches of louvers 66 formed in the flow tube 64. Then, as shown in FIG. 6, the slip tube 62 is withdrawn in direction 70 from its sock-carrying position to leave the tubular sock 54 in its snug-fitting mounted position on flow tube 64. In use, sock 54 intercepts engine exhaust discharged from flow tube 64 through louvers 66 and suppresses high-frequency noise associated with such exhaust.

Figure 7:
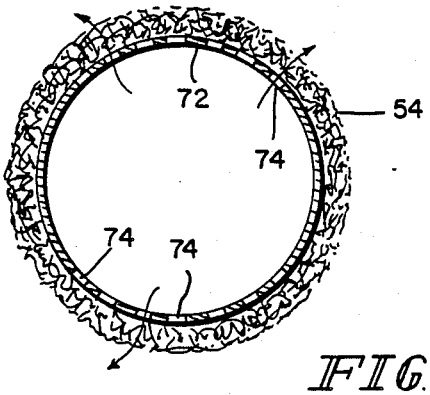
FIG. 7 is a view similar to that of FIG. 4 showing a noise attenuation sock on an exhaust tube formed to include side exhaust apertures instead of louvers.

Tubular socks 54 can be mounted on flow tubes having any kind of louver treatment, e.g., louvers, holes (any diameter or number), slots, perforation patterns, squares, etc. For example, a tubular sock 54 is shown in place on a flow tube 72 formed to include a plurality of exhaust-venting holes 74 in FIG. 7. Generally, the fibrous material used to form the tubular sock 54 is allowed to conform to a natural state snugly fitted against flow tube 72 regardless of the style of louver treatment in flow tube 72.

Tubular noise attenuation socks such as sock 54 can be used in place of bulk steel wool to control the amount of steel wool used in a noise attenuation system and to simplify manufacturability of a muffler. Placing a sock 54 on a louvered exhaust tube 66 does not significantly increase the back pressure in the muffler. It has been found that socks 54 are durable and able to withstand many backfires. In addition, they provide a temperature insulation layer of material around an exhaust flow tube.

Although the invention has been described in detail with reference to certain preferred embodiments, variations, and modifications exist within the scope and spirit of the invention as described and as defined in the following claims.

What is claimed is:

1. A noise attenuation apparatus comprising a hollow muffler housing, dividing means in the hollow muffler housing for dividing the muffler housing into at least two muffler chambers, an exhaust tube extending through the dividing means and lying in a mounted position within the muffler housing to interconnect at least two of the muffler chambers in fluid communication, the exhaust tube having a side wall formed to include a plurality of exhaust openings, and a self-supported open-ended tube sock formed to include an inner wall defining a cylindrical passage extending therethrough and an exposed outer wall spaced from the hollow muffler housing, the tube sock being made of a filter material configured to provide means for attenuating noise of exhaust passed therethrough, the exhaust tube being disposed in the cylindrical passage of the tube sock to position the side wall exhaust openings in confronting relation to the inner wall of the open-ended tube sock so that noise generated by exhaust conducted through the exhaust tube is attenuated as the exhaust exits the exhaust tube through the side wall exhaust openings and passes through the adjacent open-ended tube sock into at least one of the muffler chambers.

2. The apparatus of claim 1, wherein the open-ended tube sock is an elongated, prefabricated fibrous member.

3. The apparatus of claim 2, wherein the prefabricated fibrous member is made of stainless steel wool.

4. The apparatus of claim 2, wherein the prefabricated fibrous member is seamless.

5. The apparatus of claim 1, wherein the muffler housing is formed to include an interior region therein, the dividing means includes at least two transverse partitions disposed in the muffler housing to divide the interior region into a first chamber, a second chamber, and a third chamber therebetween, each transverse partition being formed to include at least one exhaust tube-receiving aperture therethrough providing a passage interconnecting two adjacent muffler housing chambers, the exhaust tube includes a forward end formed to include an inlet opening and a rearward end formed to include an outlet opening, the forward end extending through an exhaust tube-receiving aperture in a first transverse partition separating the first and third chambers to position the inlet opening in the first chamber, the rearward end extending through an exhaust tube-receiving aperture in a second transverse partition separating the third and second chambers to position the outlet opening in the second chamber, the side wall exhaust openings of the exhaust tube are positioned in the third chamber to permit a portion of the exhaust in the exhaust tube to be discharged into the third chamber, and the open-ended tubular sock is positioned wholly in the third chamber to surround said portion of the exhaust tube situated in the third chamber and the side wall exhaust openings formed in said portion, of the exhaust tube.

6. The apparatus of claim 5, wherein the side wall exhaust openings are defined by louvers formed in the side wall and are arranged to define at least two elongated louver sections extending between the first and second transverse portions to lie in circumferentially spaced-apart relation about the circumference of the exhaust tube, and the exhaust tube extends between the first and second transverse portions to cover each elongated louver section.

7. The apparatus of claim 5, wherein the tube sock is a prefabricated fibrous member.

8. The apparatus of claim 7, wherein the prefabricated fibrous member is made of stainless steel.

9. The apparatus of claim 7, wherein the prefabricated fibrous member is seamless.

* * * * *